US007057355B2

(12) United States Patent
Rudolph

(10) Patent No.: US 7,057,355 B2
(45) Date of Patent: Jun. 6, 2006

(54) DRIVE CIRCUIT FOR OPERATING AT LEAST ONE LAMP IN AN ASSOCIATED LOAD CIRCUIT

(75) Inventor: Bernd Rudolph, Forstern (DE)

(73) Assignee: Patent Treuhand Gesellschaft fur elektrische Gluhlampen mbH, Munich (DE)

( * ) Notice: Subject to any disclaimer, the term of this patent is extended or adjusted under 35 U.S.C. 154(b) by 0 days.

(21) Appl. No.: 10/851,227

(22) Filed: May 24, 2004

(65) Prior Publication Data

US 2004/0245938 A1 Dec. 9, 2004

(30) Foreign Application Priority Data

Jun. 6, 2003 (DE) ..... 103 25 872

(51) Int. Cl.
*H05B 37/02* (2006.01)

(52) U.S. Cl. ..... 315/209 R; 315/291; 363/37

(58) Field of Classification Search ..... 315/209 R, 315/224, 244, 291, 307, 219; 363/37
See application file for complete search history.

(56) References Cited

U.S. PATENT DOCUMENTS 4,894,587 A 1/1990 Jungreis et al. ..... 315/200
5,475,285 A * 12/1995 Konopka ..... 315/224
5,777,861 A * 7/1998 Shimizu et al. ..... 363/37
6,078,144 A * 6/2000 Twardzik ..... 315/209 R
2004/0012345 A1* 1/2004 Busse et al. ..... 315/291

FOREIGN PATENT DOCUMENTS

EP 0261018 A1 3/1988
EP 0753987 A1 1/1997
EP 0936845 8/1999

OTHER PUBLICATIONS

Search Report from European Patent Office (for related foreign application) referencing the above-listed patent documents, dated Dec. 2, 2005 (3 pages total).

* cited by examiner

*Primary Examiner*—Tuyet Vo
*Assistant Examiner*—Jimmy Vu

(57) ABSTRACT

Drive circuit for operating at least one lamp in an associated load circuit, in which terminals for the lamp are arranged, having two switches in a half-bridge arrangement, each switch including a cascode circuit of a bipolar transistor having a control, a working and a reference electrode, and a field-effect transistor having a control, a working and a reference electrode. The center point of the half-bridge arrangement is coupled to the load circuit, and each cascode circuit has an input circuit, in which a diode and a secondary winding of a transformer, connected in series, are arranged in parallel with the control electrode of the bipolar transistor and the reference electrode of the field-effect transistor, the primary winding of the transformer being arranged in the load circuit such that the load circuit current flows through it when operating the lamp.

11 Claims, 2 Drawing Sheets

DRIVE CIRCUIT FOR OPERATING AT LEAST ONE LAMP IN AN ASSOCIATED LOAD CIRCUIT

FIELD OF THE INVENTION

The present invention relates to a drive circuit for operating at least one lamp in an associated load circuit, in which the terminals for the at least one lamp are arranged, having two switches in a half-bridge arrangement.

BACKGROUND OF THE INVENTION

A drive circuit such as this known from the prior art is shown schematically in FIG. 1. The so-called intermediate circuit voltage $U_{ZW}$ is applied on the input side. In this case, the intermediate circuit voltage $U_{ZW}$ is a DC voltage which is usually generated from the system voltage using circuits which are familiar to those skilled in the art. Two switches S1, S2 are arranged in series in a half-bridge arrangement and are driven by a respective input circuit E1, E2 (not shown). The connecting point of the two switches is connected, via an inductor L, to the lamp La, through which the lamp current $I_L$ flows during operation. On the output side, the two coupling capacitors $C_{K1}$, $C_{K2}$ terminate the circuit. Alternative circuit structures are familiar to those skilled in the art, but are not described in any more detail below since they are irrelevant to the implementation of the invention. In the case of use in the so-called medium-voltage range, the switches S1, S2 must be designed for connecting voltages of between 400 and 1000 volts. The switching frequency is of the order of magnitude of from 40 to 50 kHz. The duty cycle of the circuit shown in FIG. 1 is 50 percent. The system supply power to be connected is in this case more than 100 watts. In order, furthermore, to make it possible for the system to be controlled in a relatively simple manner using microcontrollers or integrated control modules, at present MOSFETs (metal oxide semiconductor field-effect transistors) and IGBTs (insulated gate bipolar transistors) are used as the switches. Since, in the case of field-effect transistors, the forward power losses increase with the square of the current, and the chip area needs to be correlated with the forward power losses, MOSFETs are relatively expensive in the case of currents above one ampere and medium voltages of approximately 600 volts. In the case of IGBTs, on the other hand, high forward power losses result. In the case of simple bipolar transistors, in which the forward power losses are directly proportional to the current, components designed for such boundary conditions are less expensive, since they require less chip area. However, their poor dynamic switching behavior has a negative effect. Since the collector current cannot be disconnected quickly enough, the temporal overlaps with the collector-emitter voltage result in high switching losses.

SUMMARY OF THE INVENTION

The present invention therefore has the object of developing a generic drive circuit such that it has low forward power losses at medium currents of approximately 1 to 10 amperes and has at the same time low costs and a defined level of drivability using microcontrollers or integrated control modules.

This object is achieved by a drive circuit comprising a cascode circuit.

The present invention is based, on the one hand, on the knowledge that rapid switching can be achieved if a low-voltage MOSFET is used in combination with a bipolar transistor. The MOSFET need therefore only produce the small control voltage for the bipolar transistor and may therefore be small and inexpensive. The bipolar transistor, whose power loss is linked only linearly to the current flowing through it, can be dimensioned for high currents at low cost. The advantages of the MOSFET (high dynamic response and drivability using an integrated circuit) and those of the bipolar transistor (high performance which can be achieved at low cost) can thus be linked to one another in an optimum manner.

Secondly, the invention is also based on the knowledge that such a drive circuit can be started in a simple manner if some of the energy flowing in the load circuit is transferred to the input circuit of the respective switch. Since a bipolar transistor is essentially a current-controlled component, a corresponding control current needs to be provided for it at the base. For this purpose, a primary winding of a transformer is formed in the load circuit, and the secondary windings of said transformer are arranged in the input circuit of each bipolar transistor, thus supplying the base of the bipolar transistor with current. In order to reduce the forward power losses of the bipolar transistors, it is preferred to dimension the transformer such that the base current makes up approximately one fifth of the collector current. At a practical current amplification of 20, the bipolar transistor is overdriven at a ratio of 4. This results in low forward power losses. Whilst it would not be possible to use an integrated circuit to drive the bipolar transistor as a result of the high control currents required, it is very easily possible to do so using a MOSFET as an essentially voltage-controlled component.

Known from the prior art are cascode circuits having a bipolar transistor and a MOSFET transistor, but these are used for entirely different purposes: EP 0 753 987 D1 discloses the use of such a cascode circuit, in which the bipolar transistors are controlled by MOSFETs arranged in the emitter, for disconnecting a half-bridge arrangement if the lamp to be operated has aged. U.S. Pat. No. 5,998,942 (see FIG. 4 therein) likewise uses such a cascode circuit, but in this case a constant voltage is applied to the base of the bipolar transistor 20 owing to the different application. U.S. Pat. No. 4,894,587, FIG. 6, likewise discloses such a cascode circuit in which, however, in contrast to the present invention, no defined magnetization reversal of the transformer takes place. In order to prevent saturation, said transformer should only be connected for a short period of time, and then it would take at least twice as long for the magnetic field to dissipate again. Such a circuit structure could therefore not be used in the present invention. Moreover, only one such switch is used for implementing a dimming device. In the present invention, the duty cycle of the two switches of the half-bridge is essentially 50 percent, which ensures that the transformer does not become saturated since its magnetization is reversed by the respective other transistor current.

A preferred embodiment of the present invention is characterized in that a diode is arranged such that, in the case of an npn-bipolar transistor, it prevents a positive base current from flowing away via the secondary winding, and, in the case of a pnp-bipolar transistor, it prevents a negative base current from flowing away via the secondary winding. This is of importance since the base current flowing away via the secondary winding would prevent the formation of a voltage between the control electrode of the bipolar transistor and the reference electrode of the field-effect transistor, and thus the formation of a sufficiently high base-emitter voltage. At least one diode or one Zener diode can be arranged between the potential of the control electrode of the bipolar transistor and the potential of the reference electrode of the field-effect transistor, in parallel with the control electrode of the bipolar transistor and the reference electrode of the field-effect transistor. As a result, at least the voltage across the pn-junction of the diode is present as the base-emitter voltage across the pn-junction of the bipolar transistor. The bipolar transistor is thus caused to open. The same applies when using a Zener diode.

Furthermore, a non-reactive resistor and a capacitor, connected in series, are preferably arranged in parallel with the control electrode of the bipolar transistor and the reference electrode of the field-effect transistor. It is thus possible in a simple and cost-effective manner to implement the start of the drive circuit according to the invention. Detailed embodiments in this respect are explained below. The control electrode of the field-effect transistor is preferably connected to an integrated driver circuit. As already mentioned, a field-effect transistor is a voltage-controlled element which can be controlled using an integrated circuit as a result of the low requirement for control current.

The diode or the Zener diode, which is arranged between the potential of the control electrode of the bipolar transistor and the potential of the reference electrode of the field-effect transistor, in parallel with the control electrode of the bipolar transistor and the reference electrode of the field-effect transistor, is preferably dimensioned such that a voltage of at least 1 volt, preferably approximately 2 volts, is present across it.

The reference electrode of the field-effect transistor of each switch is preferably connected to a first reference potential, whereas the control electrode of the bipolar transistor of each switch is connected via a high-value resistor to a second reference potential. This resistor serves the purpose of supplying charge carriers to the base of the bipolar transistor as long as the secondary winding of the transformer does not introduce any charge carriers in the input circuit, in particular during starting.

Furthermore, a non-reactive resistor is preferably arranged between the control and the reference electrode of the bipolar transistor of each switch. This ensures that the transistor, when it is disconnected, is not connected by interference pulses at an inopportune moment. In a cascode circuit as in the present case, the resistor may also serve the purpose of charging or discharging parasitic capacitances of the field-effect transistor. Finally, said resistor also increases the dielectric strength of the bipolar transistors.

The switches are preferably designed such that when operating they can be operated at a frequency of between 100 Hz and 300 kHz and at a voltage of 100 to 1000 volts. Further advantageous embodiments are described in the subclaims.

BRIEF DESCRIPTION OF THE DRAWINGS

Exemplary embodiments of the invention will be described in more detail below with reference to the attached drawings, in which.

DETAILED DESCRIPTION OF THE INVENTION

Figure 1:
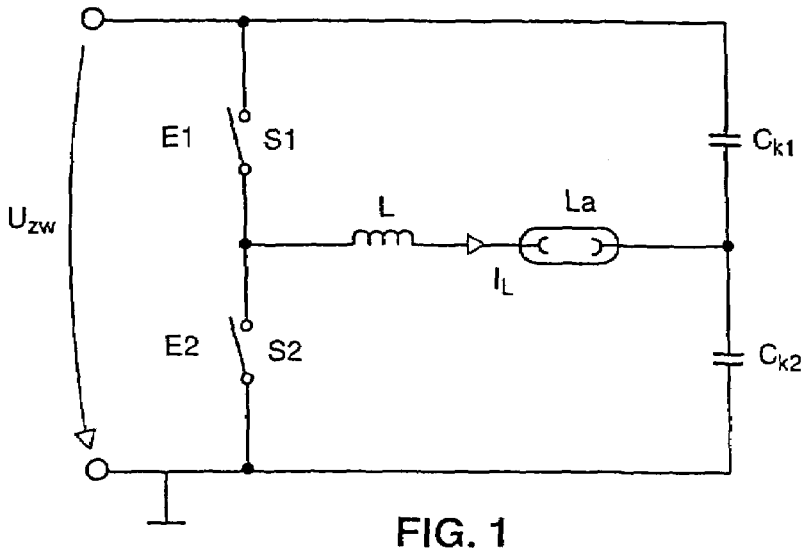
FIG. 1 shows a schematic illustration of an outline circuit diagram having a lamp driven using a half-bridge circuit.
Figure 2:
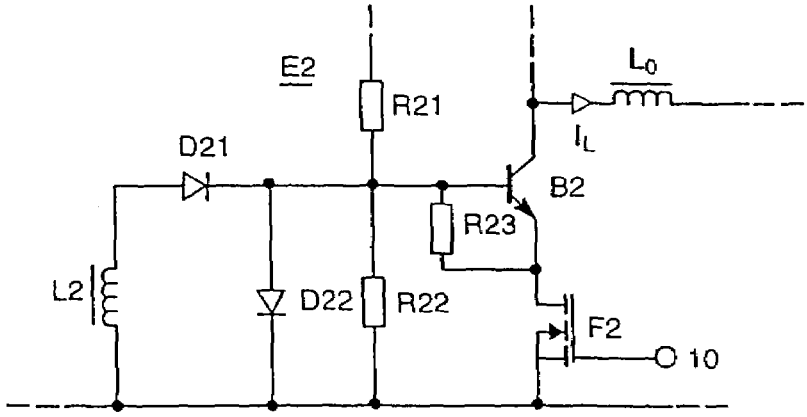
FIG. 2 shows a first exemplary embodiment of an input circuit of a drive circuit according to the invention.
Figure 3:
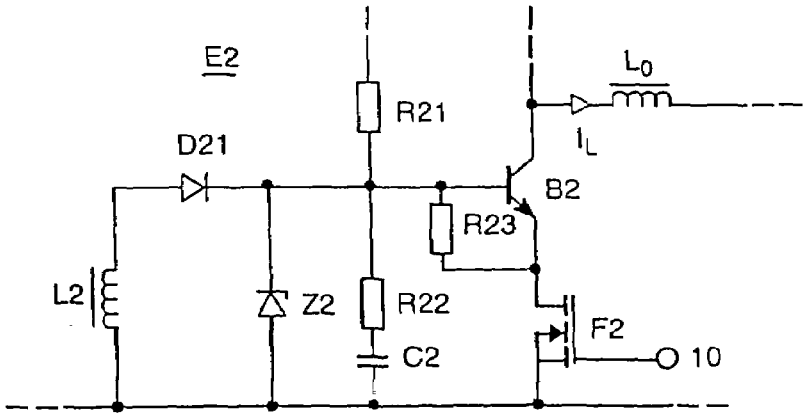
FIG. 3 shows a second exemplary embodiment of an input circuit of a drive circuit according to the invention.

FIGS. 2 and 3 show exemplary embodiments of the input circuit E2 in FIG. 1 in a drive circuit according to the invention. Identical components are provided with the same reference numerals and are explained only once. A cascode arrangement of a bipolar transistor B2 and a field-effect transistor F2 forms the switch S2. The gate of the field-effect transistor F2 is connected via its terminal 10 to the output of an integrated driver circuit. The primary winding $L_0$ of a transformer, preferably a toroidal-core transformer, is located in the load circuit. Secondary windings are arranged in the respective input circuit, in this case the secondary winding L2 in the input circuit E2. A diode D21 prevents charge carriers from flowing away from the base via the secondary winding L2. A high-value resistor R21, which is connected on the one hand to the base of the bipolar transistor B2 and on the other hand to the intermediate circuit voltage $U_{ZW}$, can be used to provide charge carriers to the base. The base of the bipolar transistor is connected on the other hand via a diode D22 and a resistor R22, connected in parallel, to the reference potential where the reference electrode of the field-effect transistor F2 is located. It is thus possible for a sufficiently high base-emitter voltage to be produced which can be used to start the circuit arrangement. A resistor R23 promotes the dielectric strength of the associated bipolar transistor.

A typical value for R21 is 1 MΩ; a typical value for R22 is 100 Ω. In place of the diode D22, a Zener diode, naturally with the reverse arrangement, may also be provided.

In FIG. 3, a secondary winding L2 and a diode D21, connected in series, are connected in parallel, on the one hand, with a Zener diode Z2 and, on the other hand, with a resistor R22 and a capacitor C2, connected in series. The base of the transistor is in turn connected via a high-value resistor R21 to the intermediate circuit voltage $U_{ZW}$ and via a resistor R23 to the working electrode of the field-effect transistor F2.

If, for example, the Zener diode Z2 is dimensioned for two volts, when the intermediate circuit voltage $U_{zw}$ is applied the capacitor C2 is charged via the resistors R22 and R21 to approximately 2 volts. When the field-effect transistor F2 is connected by means of a suitable signal at the terminal 10, as a result of which the bipolar transistor B2 opens, the capacitor C2 is discharged, and leads to a base current $I_B$ of 100 mA when the resistor R22 is dimensioned to 10 Ω. As a result, the switch S2 is connected for one to two μs, a load current $I_L$ begins to flow, and, by means of the link between the primary winding $L_0$ and the secondary winding L2, a signal is injected into the input circuit E2, as a result of which the circuit arrangement is started.

In a particularly advantageous manner, this solution also improves the disconnection behavior of the circuit. Specifically, there is the problem that, when the field-effect transistor F2 is disconnected, the emitter current $I_E$ of the bipolar transistor suddenly becomes zero. Since the collector current $I_C$ nevertheless wants to continue to flow, the base is overrun with charge carriers, which results in long disconnection times. Long disconnection times, however, are associated with the problem that the collector current $I_C$ and the collector-emitter voltage $U_{CE}$ simultaneously have positive values over a determined time period. Since the product of these two variables dominates the forward power loss, power losses which are undesirably high result. The diode D22 and the non-reactive resistor R22, connected in parallel, in FIG. 2 and the resistor R22 and the capacitor C2, connected in series, and the Zener diode Z2 in the embodiment in accordance with FIG. 3 provide a low-resistance path to ground on the base side. The collector current $I_C$ can therefore continue to flow virtually unimpeded to ground as a negative base current $-I_B$ once the field-effect transistor F2 has been disconnected. Rapid disconnection times result. The resistor R23 is dimensioned to 100 Ω, for example, and serves the purpose of ensuring that no current can flow away as long as the field-effect transistor has a high resistance value.

Figure 4:
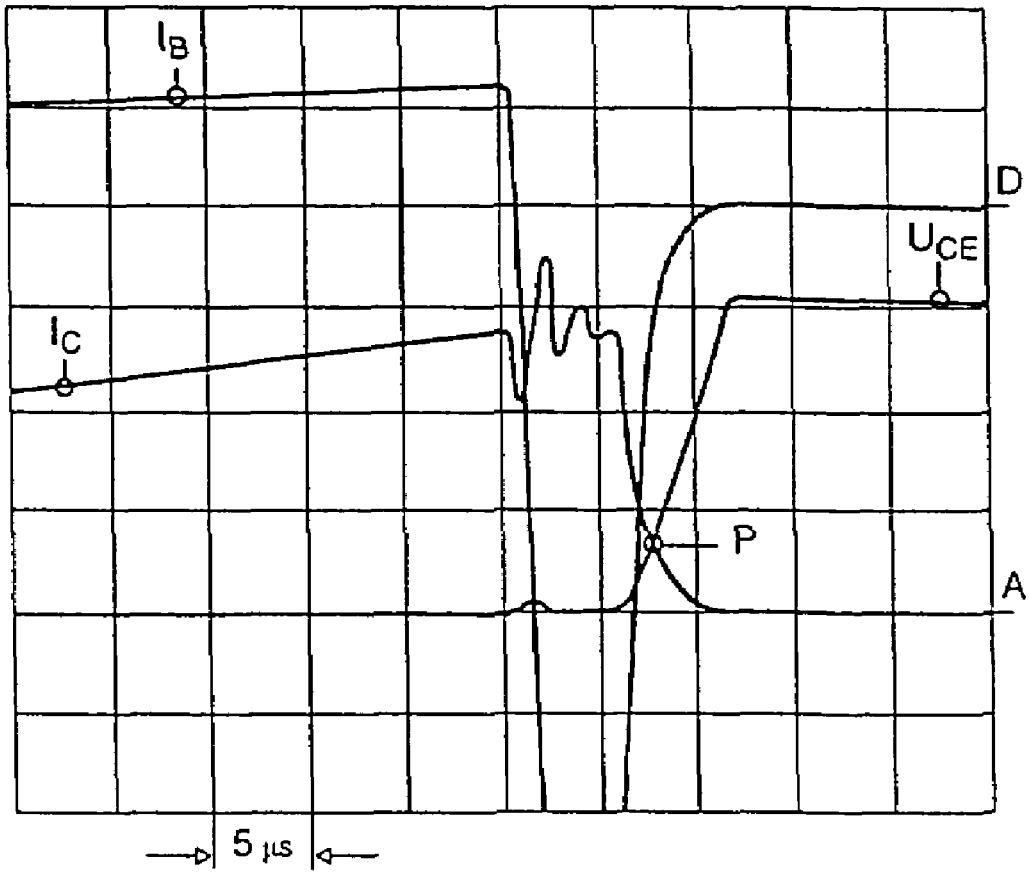
FIG. 4 shows the time characteristic of the base current, the collector current and the collector-emitter voltage when the switch of the half-bridge arrangement is disconnected in a drive circuit according to the invention.

In FIG. 4, this is confirmed by a graphically illustrated exemplary measurement using a laboratory experiment, the resolution of the base current $I_B$ being approximately one hundred times as great as the resolution of the collector current $I_C$. The base current $I_B$ falls to very low negative values, namely to $-I_C$, once the field-effect transistor has been disconnected, and increases again after a relatively short time to its zero value. The collector current likewise reaches zero after a few oscillations. The collector voltage $U_{CE}$ increases, but only at a point in time at which the collector current $I_C$ has already fallen to a very low value. The power loss, see for example the point marked P, which defines the maximum, is very low. Reference line A indicates the zero line for the collector current $I_C$; reference line D indicates the zero line for the base current $I_B$.

FIGS. 2 and 3 show, by way of example, the input circuit E2. It is obvious to those skilled in the art that the input circuit E1 should correspondingly be symmetrical with this.

The invention claimed is:

1. A drive circuit for operating at least one lamp (La) in an associated load circuit, in which the terminals for the at least one lamp are arranged, having two switches (S1, S2) in a half-bridge arrangement, each switch (S1, S2) comprising a cascode circuit of a bipolar transistor (B2) having a control, a working and a reference electrode, and a field-effect transistor (F2) having a control, a working and a reference electrode, the center point of the half-bridge arrangement being coupled to the at least one load circuit, and each cascode circuit of this type having an input circuit (E1, E2), in which a diode (D21) and a secondary winding (L2) of a transformer, connected in series, are arranged in parallel with the control electrode of the bipolar transistor (B2) and the reference electrode of the field-effect transistor (F2), the primary winding ($L_0$) of said transformer being arranged in the load circuit such that the load circuit current ($I_L$) flows through it when operating the at least one lamp (La), wherein the diode (D21) is arranged such that, in the case of an npn-bipolar transistor (B2), it prevents a positive base current ($I_B$) from flowing away via the secondary winding (L2), and, in the case of a pnp-bipolar transistor, it prevents a negative base current from flowing away via the secondary winding.

2. A drive circuit for operating at least one lamp (La) in an associated load circuit, in which the terminals for the at least one lamp are arranged, having two switches (S1, S2) in a half-bridge arrangement, each switch (S1, S2) comprising a cascode circuit of a bipolar transistor (B2) having a control, a working and a reference electrode, and a field-effect transistor (F2) having a control, a working and a reference electrode, the center point of the half-bridge arrangement being coupled to the at least one load circuit, and each cascode circuit of this type having an input circuit (E1, E2), in which a diode (D21) and a secondary winding (L2) of a transformer, connected in series, are arranged in parallel with the control electrode of the bipolar transistor (B2) and the reference electrode of the field-effect transistor (F2), the primary winding ($L_0$) of said transformer being arranged in the load circuit such that the load circuit current ($I_L$) flows through it when operating the at least one lamp (La), wherein at least one diode (D22) or one Zener diode (Z2) is arranged between the potential of the control electrode of the bipolar transistor (B2) and the potential of the reference electrode of the field-effect transistor (F2), in parallel with the control electrode of the bipolar transistor (B2) and the reference electrode of the field-effect transistor (F2).

3. The drive circuit as claimed in claim 1, characterized in that at least one diode (D22) or one Zener diode (Z2) is arranged between the potential of the control electrode of the bipolar transistor (B2) and the potential of the reference electrode of the field-effect transistor (F2), in parallel with the control electrode of the bipolar transistor (B2) and the reference electrode of the field-effect transistor (F2).

4. A drive circuit for operating at least one lamp (La) in an associated load circuit, in which the terminals for the at least one lamp are arranged, having two switches (S1, S2) in a half-bridge arrangement, each switch (S1, S2) comprising a cascode circuit of a bipolar transistor (B2) having a control, a working and a reference electrode, and a field-effect transistor (F2) having a control, a working and a reference electrode, the center point of the half-bridge arrangement being coupled to the at least one load circuit, and each cascode circuit of this type having an input circuit (E1, E2), in which a diode (D21) and a secondary winding (L2) of a transformer, connected in series, are arranged in parallel with the control electrode of the bipolar transistor (B2) and the reference electrode of the field-effect transistor (F2), the primary winding ($L_0$) of said transformer being arranged in the load circuit such that the load circuit current ($I_L$) flows through it when operating the at least one lamp (La), wherein a non-reactive resistor (R22) and a capacitor (C2), connected in series, are arranged in parallel with the control electrode of the bipolar transistor (B2) and the reference electrode of the field-effect transistor (F2).

5. The drive circuit as claimed in claim 3, characterized in that a non-reactive resistor (R22) and a capacitor (C2), connected in series, are arranged in parallel with the control electrode of the bipolar transistor (B2) and the reference electrode of the field-effect transistor (F2).

6. A drive circuit for operating at least one lamp (La) in an associated load circuit, in which the terminals for the at least one lamp are arranged, having two switches (S1, S2) in a half-bridge arrangement, each switch (S1, S2) comprising a cascode circuit of a bipolar transistor (B2) having a control, a working and a reference electrode, and a field-effect transistor (F2) having a control, a working and a reference electrode, the center point of the half-bridge arrangement being coupled to the at least one load circuit, and each cascode circuit of this type having an input circuit (E1, E2), in which a diode (D21) and a secondary winding (L2) of a transformer, connected in series, are arranged in parallel with the control electrode of the bipolar transistor (B2) and the reference electrode of the field-effect transistor (F2), the primary winding ($L_0$) of said transformer being arranged in the load circuit such that the load circuit current ($I_L$) flows through it when operating the at least one lamp (La), wherein the control electrode of the field-effect transistor (F2) is connected to an integrated driver circuit.

7. The drive circuit as claimed in claim 5, characterized in that the control electrode of the field-effect transistor (F2) is connected to an integrated driver circuit.

8. A drive circuit for operating at least one lamp (La) in an associated load circuit, in which the terminals for the at least one lamp are arranged, having two switches (S1, S2) in a half-bridge arrangement, each switch (S1, S2) comprising a cascode circuit of a bipolar transistor (B2) having a control, a working and a reference electrode, and a field-effect transistor (F2) having a control, a working and a reference electrode, the center point of the half-bridge arrangement being coupled to the at least one load circuit, and each cascode circuit of this type having an input circuit (E1, E2), in which a diode (D21) and a secondary winding (L2) of a transformer, connected in series, are arranged in parallel with the control electrode of the bipolar transistor (B2) and the reference electrode of the field-effect transistor (F2), the primary winding ($L_0$) of said transformer being arranged in the load circuit such that the load circuit current ($I_L$) flows through it when operating the at least one lamp (La), wherein the duty cycle of the two switches (S1, S2) of the half-bridge is essentially 50 percent.

9. The drive circuit as claimed in claim 2, characterized in that the diode (D22) or the Zener diode (Z2) is dimensioned such that a voltage of at least 1 V, preferably approximately 2 V, is present across it.

10. A drive circuit for operating at least one lamp (La) in an associated load circuit, in which the terminals for the at least one lamp are arranged, having two switches (S1, S2) in a half-bridge arrangement, each switch (S1, S2) comprising a cascode circuit of a bipolar transistor (B2) having a control, a working and a reference electrode, and a field-effect transistor (F2) having a control, a working and a reference electrode, the center point of the half-bridge arrangement being coupled to the at least one load circuit, and each cascode circuit of this type having an input circuit (E1, E2), in which a diode (D21) and a secondary winding (L2) of a transformer, connected in series, are arranged in parallel with the control electrode of the bipolar transistor (B2) and the reference electrode of the field-effect transistor (F2), the primary winding ($L_0$) of said transformer being arranged in the load circuit such that the load circuit current ($I_L$) flows through it when operating the at least one lamp (La), wherein the reference electrode of the field-effect transistor (F2) of each switch (S1, S2) is connected to a first reference potential, and the control electrode of the bipolar transistor of at least one switch is connected via a high-value resistor (R21) to a second reference potential ($U_{ZW}$).

11. A drive circuit for operating at least one lamp (La) in an associated load circuit, in which the terminals for the at least one lamp are arranged, having two switches (S1, S2) in a half-bridge arrangement, each switch (S1, S2) comprising a cascode circuit of a bipolar transistor (B2) having a control, a working and a reference electrode, and a field-effect transistor (F2) having a control, a working and a reference electrode, the center point of the half-bridge arrangement being coupled to the at least one load circuit, and each cascode circuit of this type having an input circuit (E1, E2), in which a diode (D21) and a secondary winding (L2) of a transformer, connected in series, are arranged in parallel with the control electrode of the bipolar transistor (B2) and the reference electrode of the field-effect transistor (F2), the primary winding ($L_0$) of said transformer being arranged in the load circuit such that the load circuit current ($I_L$) flows through it when operating the at least one lamp (La), wherein the switches (S1, S2) are designed such that when operating they are operated at a frequency of between 100 Hz and 300 kHz and at a voltage of 100 to 1000 V.

* * * * *